US006263516B1

(12) United States Patent
Pedersen et al.

(10) Patent No.: US 6,263,516 B1
(45) Date of Patent: Jul. 24, 2001

(54) TOILET COVER ASSEMBLY

(75) Inventors: Kjeld Bruno Pedersen, Ry; Dan Boyter, Århus C; Klaus Rehnquist, Skanderborg; Torkil Carlsen, Ry; Benny Nielsen, Skanderborg, all of (DK)

(73) Assignee: Pressalit A/S (DK)

( * ) Notice: Subject to any disclaimer, the term of this patent is extended or adjusted under 35 U.S.C. 154(b) by 0 days.

(21) Appl. No.: 09/554,642

(22) PCT Filed: Dec. 10, 1998

(86) PCT No.: PCT/DK98/00542

§ 371 Date: May 17, 2000

§ 102(e) Date: May 17, 2000

(87) PCT Pub. No.: WO99/29222

PCT Pub. Date: Jun. 17, 1999

(30) Foreign Application Priority Data

Dec. 10, 1997 (DK) ..... 1997 01434

(51) Int. Cl.[7] ..... A47K 13/12
(52) U.S. Cl. ..... 4/236
(58) Field of Search ..... 4/236, 240

(56) References Cited

U.S. PATENT DOCUMENTS 3,506,983 * 4/1970 Coggins ..... 4/236
6,071,034 * 6/2000 Cavagna ..... 4/236 X

FOREIGN PATENT DOCUMENTS 4409516 9/1994 (DE) .

* cited by examiner

*Primary Examiner*—Charles E. Phillips
(74) *Attorney, Agent, or Firm*—Ladas and Parry

(57) ABSTRACT

A toilet cover assembly comprising a seat (1) and a cover (2) interconnected by means of two interspaced hinges (5). Each hinge (5) comprises a seat hinge eye member (6) and an adjacent cover hinge eye member (7) and a bushing (9) on which the hinge eye members are arranged as well as a mounting member (11) having a freely projecting hinge pin (10) accommodated in the bushing (9). The bushing (9) is resilient in the portion at an inner radial projection (34), whereby the inner projection (34) may be brought into and out of engagement with a recess (41) on the hinge pin (10) with the eye members (6, 7) arranged on the bushing (9). Furthermore the bushing (9) is resilient in the portion at a radially extending projection (28), whereby the outer projection (28) may be inserted through the eye members (6, 7) prior to insertion of the hinge pin (10) in the bushing (9).

9 Claims, 2 Drawing Sheets

TOILET COVER ASSEMBLY

TECHNICAL FIELD

The invention relates to a toilet cover assembly comprising a seat and a cover which adjacent their respective rearmost edges are interconnected by means of two interspaced hinges having horizontal axes, each hinge comprising a seat hinge eye member and an adjacent cover hinge eye member, a hinge bushing having an outer bearing surface, on which the seat hinge eye member and the cover hinge eye member are rotatably arranged, and a first outer, radially extending projection abutting an edge face of the seat hinge eye member of and/or of the cover hinge eye member, said toilet cover assembly further comprising a mounting member provided with fastening means for fastening the assembly to a toilet bowl as well as a freely projecting, horizontal hinge pin having a circumferential recess accommodating an inner, radially extending projection on the bushing.

BACKGROUND ART

On toilet bowls of different makes, the mounting apertures for mounting the cover assembly are arranged with varying interspacing and also with varying spacing from the opening of the toilet bowl. Thus, the hinges of toilet cover assemblies are often adjustable to enable mounting thereof on a great number of different toilet bowls while maintaining a correct positioning of the seat relative to the rim of the bowl. However this adjustability entails that it might be difficult to mount the cover assembly correctly on the bowl, in that it has to be ensured during the mounting that the bushing does not shift on the hinge pin and the hinge eye members do not shift on the bushing.

DE-A1-44 09 516 discloses a toilet cover assembly of the above type, wherein the inner projection of the bushing engages the recess of the hinge pin such that it cannot be removed from the pin (see column 2, line 68 to column 3. line 6). The hinge eye members of the cover and the seat are prevented from against axial displacement relative to the bushing by means of an inner collar and an inwardly projecting tooth provided on the outer hinge eye member and engaging a groove in the bearing surface of the bushing. The hinges of this toilet cover assembly only allow insertion of the hinge pin and its bushing into the hinge eye member from one side, which limits the adjustability of the hinges when said hinges are to be mounted on toilet bowls with varying spacing between the mounting holes contrary to those shown in this document.

BRIEF DESCRIPTION OF THE INVENTION

The object of the present invention is thus to provide a toilet cover assembly of the above type comprising hinges that facilitate mounting of the assembly on the toilet bowl, even when the hinges are adjustable to enable mounting of toilet cover assembly on toilet bowls having varying interspacing between the holes.

The toilet cover assembly according to the invention is characterised in that the bushing is resilient in the portion at the inner projection and that the radial dimension of the inner projection, the dimension of the bearing surface at least in the portion at the inner projection and the inner dimension of the eye members are all adapted such that the inner projection may be brought into and out of engagement with the recess of the hinge pin by insertion of the pin into the bushing and removal of the pin from the bushing when the eye members are accommodated on the bearing surface of the bushing and that the bushing is resilient in the portion at the first outer projection such that the portion may be inserted through the eye members when the eye members are to be received on the bearing surface before the hinge pin is inserted into the bushing.

This structure of the bushing makes it possible—prior to insertion of the hinge pin therein—to insert the bushing in the hinge eye members from both sides thereof, and subsequently insert the hinge pin into the bushing. If the toilet cover assembly cannot be placed correctly on the toilet bowl with the chosen insertion direction of the bushing, the hinge pin can be pulled out of the bushing, which in turn can be pulled out of the hinge eye members. Subsequently hereto the bushing is inserted into the eye members from the other side, whereafter the hinge pin is reinserted into the bushing to enable correct mounting of the toilet cover assembly on the toilet bowl.

According to the invention the bushing may be provided with preferably axially extending first slots in the portion at the first outer projection. As a result the bushing becomes resilient in the portion at the first outer projection at the same time as it is possible to use a comparativelv rigid material for the bushing, whereby the accommodation of the eye member or eye members on the bearing surface is obtained by means of a snapping effect.

Furthermore according to the invention the bushing may at one end be provided with a second outer, radially extending projection spaced apart from the first outer projection and abutting an edge face of the cover hinge eye member or the seat hinge eye member. As both the first outer projection and the second outer projection abut an edge face of the cover hinge eye member or the seat hinge eye member, the seat and cover are prevented from axial displacement on the bushing and are thus securely held together before insertion of the hinge pin in the bushing. This feature is advantageous in connection with packing and dispatch of the toilet cover assembly.

Moreover according to the invention the first projection of the bushing may be arranged at the other end of the bushing, whereby the two projections are arranged at respective ends of the bushing and abutting the outwardly facing edge face of the respective hinge eye member when the eye members have been arranged on the bearing surface of the bushing.

According to the invention the bushing may be closed at the end provided with the second outer projection. The closed end of the bushing and the outer projection are situated at the outer end of the hinge pin, when this has been inserted into the bushing and thus conceal the hinge pin in an appealing manner.

Furthermore according to the invention the first outer projection may be provided with a front ramp face inclining outwardly towards the rear when seen in relation to the insertion direction of the bushing to facilitate insertion of the bushing into the hinge eye members.

Moreover according to the invention the bushing may be provided with preferably axially extending additional slots in the portion at the inner projection. As a result resilience of the bushing in the portion at the inner projection is obtained in a simple manner at the same time as it is possible to use a comparatively rigid material for the bushing such that the engagement between the projection and recess of the hinge pin is obtained by a snapping effect.

According to the invention the bearing surface of the bushing may also be provided with a depression in the portion at the inner projection to allow for radial deflection at insertion of the hinge pin into the bushing to bring the inner projection into engagement with the recess of the hinge pin.

Finally according to the invention the inner projection may have side faces converging in inwardly direction.

BRIEF DESCRIPTION OF THE DRAWING

The invention is explained in greater detail below with reference to the accompanying drawings, in which.

BEST MODE FOR CARRYING OUT THE INVENTION

Figure 1:
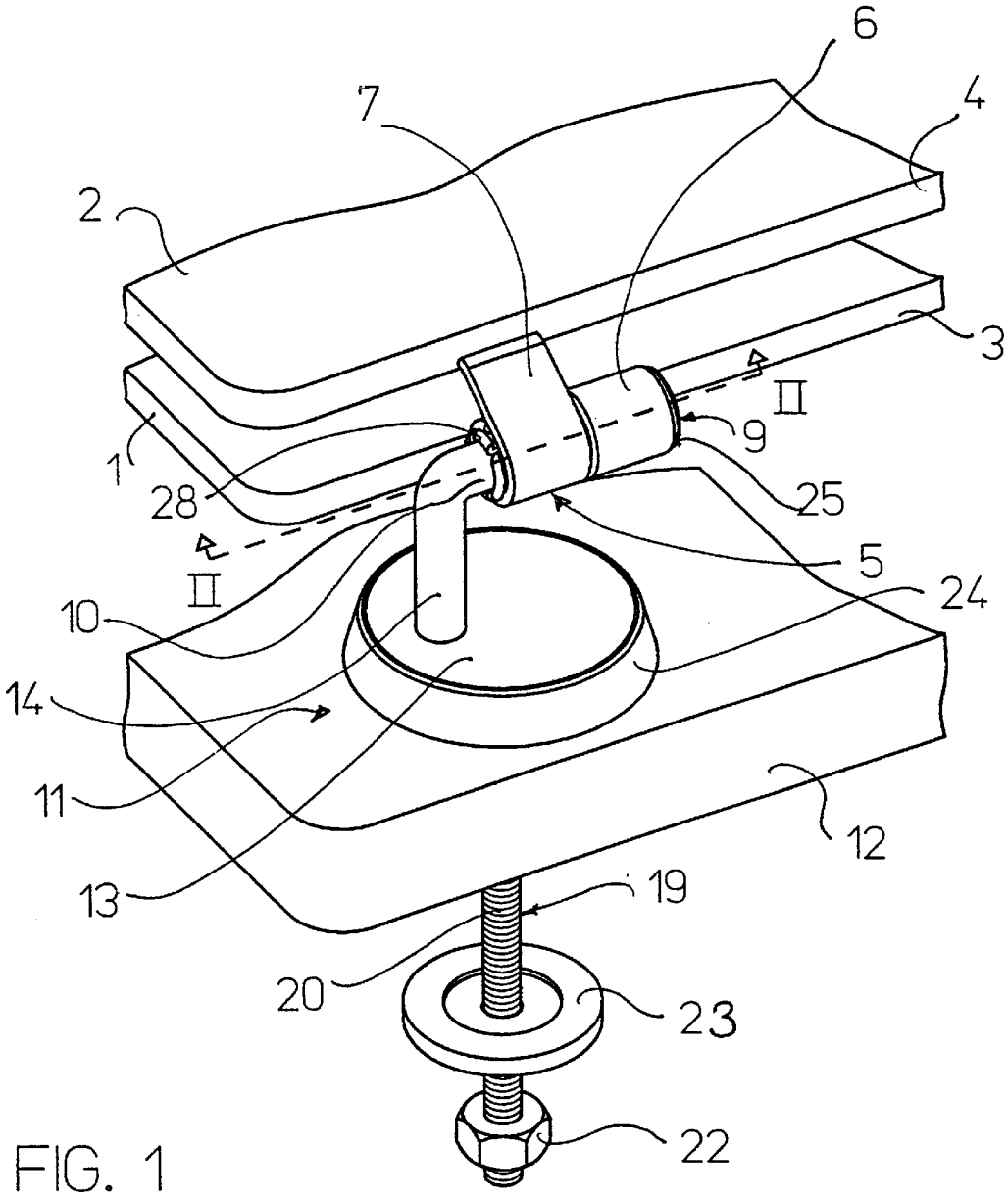
FIG. 1 is a perspective view of a portion of the toilet cover assembly according to the invention mounted on a toilet bowl.

The toilet cover assembly according to the invention illustrated on the drawings comprises a toilet seat 1 and a toilet cover 2 being interconnected at their rearmost portions 3,4 by means of two interspaced hinges 5 with horizontal axes of which only one is visible on the drawing, the toilet cover assembly being substantially symmetrical about a central plane perpendicular to the hinge axis.

Each hinge 5 comprises a seat hinge eye member 6 connected to the seat land an adjacent cover hinge eye member 7 connected to the cover 2. The hinge eye members 6,7 are rotatably arranged on an outer bearing surface 8 of a hinge bushing 9 made of plastic, eg. of polyethylene. The hinge bushing 9 is arranged on a hinge pin 10 forming part of a mounting member 11 for mounting the toilet cover assembly on a toilet bowl 12.

Figure 2:
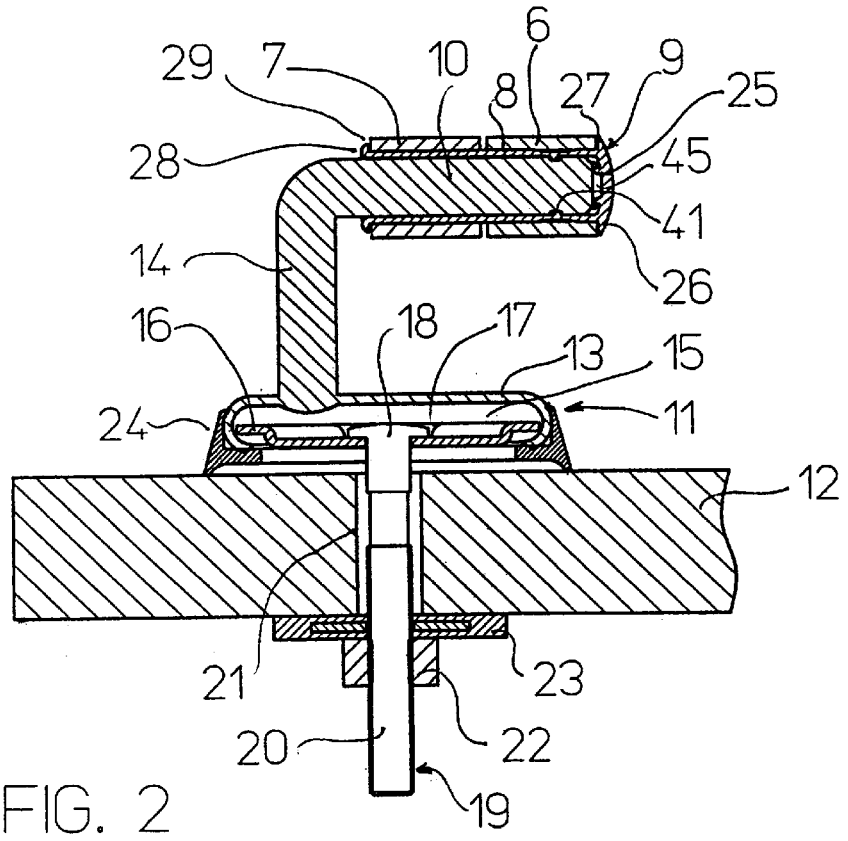
FIG. 2 is a vertical sectional view along the line II—II in FIG. 1 through a hinge of the toilet cover assembly according to the invention.

As illustrated in FIGS. 1 and 2, the mounting member 11 comprises a circular base 13 and a post 14 extending upwardly from the base and being displaced in relation to the centre thereof, said post being bent 90° to form the hinge pin 10. The base 13 is provided with a cavity 15 housing a rotatable bottom plate 16 having an oblong slit 17. A head 18 of a screw 19 is accommodated in the cavity 15 of the base 13 and the shank of the screw 20 extends through the slit 17 and through a hole 21 in the toilet bowl 12. The mounting member 11 is secured to the toilet bowl 12 by means of a nut 22 and a washer 23 on the screw 19. A sleeve 24 arranged at the periphery of the base 13 extends downwardly to abut the upper face of the toilet bowl 12 in the mounted state of the mounting member 11.

The off-centre positioning of the post 14 on the base 13 and the bottom plate 16 rotatably arranged in the base and provided with the oblong slot 17 enable mounting of the toilet cover assembly on many different types of toilet bowls having varying interspacing between the mounting holes 21 and varying positions of the mounting apertures in relation to the opening of the toilet bowl.

Figure 3:
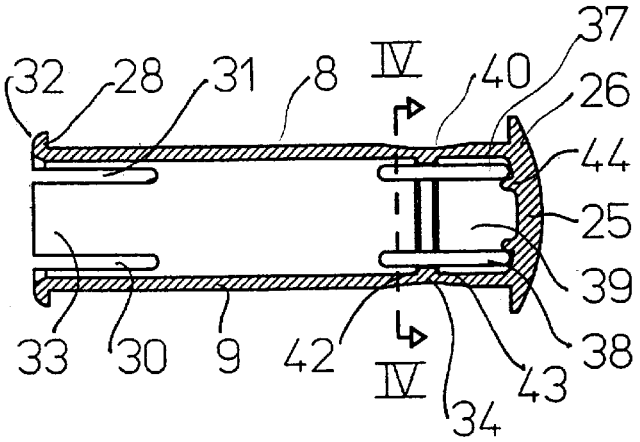
FIG. 3 is longitudinal sectional view through a hinge bushing of the hinge of the toilet cover assembly.
Figure 4:
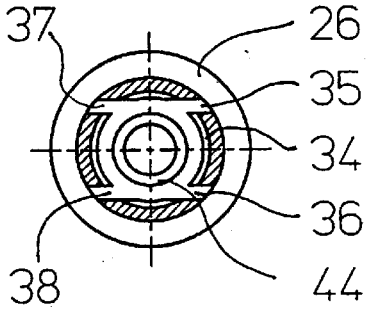
FIG. 4 is a sectional view along the line IV—IV in FIG. 3.

As particularly evident in FIGS. 2 to 4, at one end the bushing 9 is provided with a head 25 closing the bushing and forming a radially outwardly projecting collar 26 thereon abutting the outwardly facing edge face 27 of the seat hinge eye member 6. At the other end of the bushing 9 a radially outwardly extending, circumferential projection 28 is provided which abuts the inner edge face 29 of the cover hinge eye member 7. The internal distance between the projection 28 and the collar 26 substantially correspond the total length of the seat hinge eye member 6 and the cover hinge eye member 7 such that the bushing hold these together. For passing the projection 28 through the eye members 6,7, when these are to be received on the bearing face 8 of the bushing 9 prior to insertion of the hinge pin 10 in the bushing 9, the projection 28 and the portion of the bushing at the projection 28 are slotted by means of four radially through-going and axially extending slots, of which only the slots 30,31 are visible on FIG. 3. When seen in the insertion direction of the bushing into the eye members 6,7, the projection 28 is provided with a ramp face 32 inclining outwardly towards the rear, said ramp face facilitating the insertion of the bushing into the eye members and enhances the deflection of the tongues 33 of the bushing between the slots 30,31. Due to the abutment between the inner face of the bushing 9 and the outer surface of the hinge pin 10, the tongues 33 are prevented from deflecting, when the hinge pin 10 has been inserted in the bushing 9.

As illustrated in FIGS. 2 to 4 on its inner surface the bushing 9 is provided with a projection 34 extending radially inwardly and axially spaced apart from the outer projection 28 and the head 25. The circumferential, inner projection 34 and the portion of the bushing 9 at the inner projection are slotted by means of radially through-going and axially extending slots 35,36,37, 38 to form radially resilient webs 39 arranged between said slots. Furthermore a depression 40 is provided in the bearing face 8 of the bushing in the portion at the inner projection 34. The depression 40 is formed and dimensioned such in relation to the radial height of the projection and the inner diameter of the hinge eye members 6,7 that, when the eye members have been arranged on the bearing face 8 of the bushing, the hinge pin 10 may be inserted into the bushing 9 and the inner projection 34 engages a circumferential recess 41 in the outer surface of the hinge pin 10. The inner projection 34 is provided with side faces 42,43 converging in inward direction, whereby the inner projection 34 may be brought into and out of engagement with the recess 41 in a snap-like manner.

Finally, on its inner bottom the bushing 9 is provided with an annular bead 44 axially spaced apart from the inner projection 34 by substantially the same distance as the axial distance between the recess 41 of the hinge pin 10 and the outer end face 45. As a result, the inner projection 34 engages the recess 41, when the end face 45 of the hinge pin 10 abuts the bead 44 in the bottom of the bushing.

As mentioned above the bushing is made of plastic such as polyethylene. The hinge eye members 6, 7 and the mounting member 11 are preferably made of stainless steel, while the sleeve 24 preferably is made of plastic.

What is claimed is:

1. Toilet cover assembly comprising a seat (1) and a cover (2) which adjacent their respective rearmost edges are interconnected by means of two interspaced hinges (5) having horizontal axes, each hinge (5) comprising a seat hinge eye member (6) and an adjacent cover hinge eye member (7), a hinge bushing (9) having an outer bearing surface (8), on which the seat hinge eye member (6) and the cover hinge eye member (7) are rotatably arranged, and a first outer, radially extending projection (28) abutting an edge face (29) of the seat hinge eye member and/or of the cover hinge eye member, said toilet cover assembly further comprising a mounting member (11) provided with fastening means for fastening thereof on a toilet bowl (2) and a freely projecting hinge pin (10) having a circumferential recess (41) accommodating an inner, radially inwardly extending projection (34) on the bushing (9), characterised in that the bushing (9) is resilient in the portion at the inner projection (34) and that the radial dimension of the inner projection (34), the dimension of the bearing surface (8) at least in the portion at the inner projection (34) and the inner diameter of the hinge eye members (6,7) are adapted such in relation to one another that the inner projection may be brought into and out of engagement with the recess (41) of the hinge pin (10) by insertion of the pin (10) into the bushing (9) and removal of the pin (10) from the bushing (9), when the hinge eye members (6,7) are accommodated on the bearing face (8) of the bushing, and that the bushing (9) is resilient in the portion at the outer projection (28) such that this portion may be led through the eye members (6,7) when said eye members are to be received on the bearing face (8) before the hinge pin (10) is inserted into the bushing (9).

2. Toilet cover assembly according to claim 1, characterised in that the bushing (9) is provided with preferably axially extending first slots (30,31) in the portion at the first outer projection (28).

3. Toilet cover assembly according to claim 1, characterised in that at one end the bushing (9) is provided with a second outer, radially extending projection (26) spaced apart from the first outer projection (28) and abutting an edge face of the seat hinge eye member (6) or the cover hinge eye member (7).

4. Toilet cover assembly according to claim 3, characterised in that the first outer projection (28) of the bushing (9) is arranged at the other end of the bushing.

5. Toilet cover assembly according to claim 3, characterised in that the bushing (9) is closed at the end provided with the second outer projection (26).

6. Toilet cover assembly according to claim 1, characterised in that the first outer projection (28) is provided with a front ramp face (32) inclining outwardly towards the rear when seen in the insertion direction of the bushing into the eye members (6,7).

7. Toilet cover assembly according to claim 1, characterised in that the bushing (9) is provided with preferably axially extending additional slots (35, 36, 37, 38) in the portion at the inner projection (34).

8. Toilet cover assembly according to claim 1, characterised in that the bearing surface (8) of the bushing (9) is provided with a depression (40) in the portion at the inner projection (34).

9. Toilet cover assembly according to claim 1, characterised in that inner projection (34) is provided with side faces (42,43) converging in radially inward direction.

* * * * *